US008296989B1

(12) United States Patent
Hawthorne et al.

(10) Patent No.: US 8,296,989 B1
(45) Date of Patent: Oct. 30, 2012

(54) ADAPTER EXTENSION FOR RIFLE FIRED MUZZLE MOUNTED GRENADES

(75) Inventors: Anthony Hawthorne, Vernon, NJ (US); Kenneth R. Jones, Wayne, NJ (US); Richard A. Beckman, Randolph, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 81 days.

(21) Appl. No.: 12/699,960

(22) Filed: Feb. 4, 2010

(51) Int. Cl.
*F41C 27/06* (2006.01)

(52) U.S. Cl. ..... 42/105; 42/77; 403/109.3

(58) Field of Classification Search ..... 42/105, 42/77, 79, 76.01; 89/14.4, 1.3, 16; 403/109.3, 403/DIG. 4; 285/317
See application file for complete search history.

(56) References Cited

U.S. PATENT DOCUMENTS

| | | | | |
|---|---|---|---|---|
| 1,130,609 | A * | 3/1915 | Jones | 181/223 |
| 3,318,033 | A * | 5/1967 | Barr | 42/105 |
| 5,033,777 | A * | 7/1991 | Blenkush | 285/317 |
| 7,677,150 | B2 * | 3/2010 | Dater et al. | 89/14.05 |
| 2002/0036406 | A1 * | 3/2002 | Parker | 285/282 |
| 2008/0098880 | A1 * | 5/2008 | Brugger | 89/14.4 |

* cited by examiner

*Primary Examiner* — Daniel Troy
(74) *Attorney, Agent, or Firm* — Henry S. Goldfine

(57) ABSTRACT

A rifle barrel adapter that ensures adequate mounting overlap for muzzle mounted grenades for proper firing alignment is described, which adapter is formed of only four parts: (1) an elongated unitary body with a narrowed cylindrical front section upon which the muzzle mounted grenade is mounted, which elongated unitary body has an enlarged rear section that is mounted about the muzzle end of the rifle barrel over the flash suppressor; (2) a unitary locking mechanism to secure the elongated unitary body to the muzzle end of the rifle; (3) a bias spring to maintain the unitary locking mechanism in place, and (4) a locking pin to hold the unitary locking mechanism in place within the unitary body.

7 Claims, 3 Drawing Sheets

ADAPTER EXTENSION FOR RIFLE FIRED MUZZLE MOUNTED GRENADES

STATEMENT REGARDING FEDERALLY SPONSORED RESEARCH OR DEVELOPMENT

The invention described herein may be made, used, or licensed by or for the United States Government for Government purposes without the payment of any royalties therefore.

BACKGROUND OF THE INVENTION

1. Field of the Invention

The present invention is generally directed to an adapter that allows rifle launched, muzzle mounted grenades to be accurately launched from short barreled rifles and, more particularly, to such an adapter that is simple in design so as to be reliable under battlefield conditions.

2. Description of Related Art

Rifle fired grenades provide enhanced velocity and accuracy to effectively deliver a grenade at a significantly greater distance than one hand thrown. Generally such grenades can be fired directly from the muzzle of a rifle, or fired from an attachment to the rifle, such as the M203 grenade launcher, which can be attached to an M4A1 carbine.

U.S. Pat. No. 3,307,283, incorporated herein by reference, discloses a firearm grenade launcher that is muzzle mountable to various caliber rifles, using a hollow cylindrical adapter to fit about the front end of the rifle's muzzle and about the rifle's front sight, in order to increase the outside diameter of the muzzle to that of the inside diameter of the hollow adapter. Both the adapter's and launcher's hollow cylindrical bodies are split into arcual sections by longitudinal slots, which arcual sections can be forced together using a flexible steel hose clamp located about the periphery of the launcher's mounting section. An angularly shaped handle is provided to tighten the hose clamp, thereby compressing the launcher's arcual sections about the adapter and the adapter' accrual sections about the muzzle (of such various caliber rifles). In addition to the complexity of this split section adapter/launcher combination, a special "blank" launching cartridge is fired through the hollow adapter and launcher, and into the rear of the grenade to shoot the grenade.

U.S. Pat. No. 4,567,831, incorporated herein by reference, discloses a particular muzzle fired grenade which is fitted directly about the rifle's muzzle and launched by firing a bullet directly into a bullet trap therein. However, such direct mounting of the grenade about the muzzle end is problematic when using relatively short barrel military rifles, that provide only a short muzzle length extending therefrom; such as, the 5.56 mm, Heckler & Koch manufactured HK416, with a D10RS (10.4 inch) barrel, or Fabrique National de Herstal manufactured SCAR-L Short (10.0 inch) barrel. In such cases, there isn't sufficient overlap between the barrel and the muzzle mounted grenade to (1) ensure the properly alignment of the grenade on target; to (2) ensure the bullet's accurate entry into the trap so as to properly trigger the grenade's fuze; and to (3) avoid any off-alignment effects caused by gas escape from sides of the muzzle flash suppressor in a non-uniform manner (as, in general, military rifles are standardly equipped with a muzzle mounted flash suppressor).

A particular muzzle mounted, "bullet trap" fired grenade of interest is the GREM, or Grenade Rifle Entry Munition, such as the "Simon" manufactured by Rafael, the Israeli Authority for Development of Weapons. The "Simon" is designed to muzzle mount directly on 5.56 mm rifles. U.S. Pat. No. 3,307,283 disclosed special "blank" firing adapter/launcher is not functional with such "bullet-trap" muzzle mounted grenade; and, is not designed for military rifles such as the HK416 and SCAR-L which do not utilize a front barrel mounted sight—the sights on the HK416 and SCAR-L are raised above the body of the rifle, i.e. there is no forward sight to secure a U.S. Pat. No. 3,307,283 type slotted adapter.

There is clearly a need in the art for a simple (i.e. reliable under battle field conditions), low cost, quick mounting muzzle adapter to lengthen short barrel military rifles to accommodate and accurately fire muzzle mounted, bullet trap type grenades from modern rifles having raised sights.

SUMMARY OF THE INVENTION

Objectives of the present invention address the needs detailed above, including providing a quick mounting, relatively simple (for improved reliability under battlefield conditions), low cost adapter, to extend the length of modern short barreled military rifles, to securely mount thereabout a muzzle mounted grenade, such as the bullet trap "Simon"—to accurately fire such grenades therefrom. To realize these objectives, the subject inventive muzzle grenade adapter is formed of only four parts; specifically: (1) an elongated unitary body, which is mounted on the muzzle end of the rifle barrel over the rifle's flash suppressor, (2) a unitary locking mechanism to secure the unitary body to the muzzle end, (3) a bias spring to maintain the locking mechanism in place, and (4) a locking pin to hold the locking mechanism in place within the unitary body. The unitary body has an enlarged, hollow, generally cylindrical rear section, to accommodate the muzzle end of the rifle and any flash suppressor therein; which rear section is aligned with a hollow, narrower, generally cylindrical front section, to accommodate the muzzle fired grenade about the exterior of the front end thereof; with an aligned hollow tapering down section connecting the enlarged and narrower sections. Any bullet fired will pass from the muzzle/flash suppressor through the center of the aligned hollow enlarged, tapered down, and narrowed sections, along the center line thereof, into the bullet trap within the muzzle grenade that is mounted about the exterior front end of the narrowed section.

As stated, the unitary locking mechanism secures the adapter in place about the end of the rifle's muzzle/flash suppressor, and a locking pin secures the unitary locking mechanism within the adapter's unitary body. The unitary locking mechanism, which is located adjacent the rear of the enlarged cylindrical rear section, has an upper section with a finger push, integral with two side column push sections—which side column push sections extend through an upper channel cut-out in the enlarged, hollow, generally cylindrical rear section, and along each side of thereof in opposed column channels. Each column push section extends to and connects with the sides of a lower arcual section which is generally aligned perpendicular to the center line thereof and which arc opens to face the hollow inner part, of the enlarged rear cylindrical section. The arcual lower section of the locking mechanism forms a tongue that fits into a corresponding arcual groove about the rear of the rifle's flash suppressor—when the front end of the rifle's flash suppressor is inserted into the enlarged rear section until the front end thereof impacts the tapered section of the adapter.

The finger push section is biased by a bias spring located between the outer surface of the enlarged rear section of the unitary body and the bottom side of the finger push. The spring has a normal bias that will tend to hold the finger push away from the exterior surface of the enlarged rear section.

When the finger push section is pressed into a corresponding cut-out within the exterior surface of the enlarged section of the muzzle grenade adapter, i.e. when the bias spring is depressed between the finger push and the outer surface of the enlarged section, the side column push sections will push the lower section of the unitary locking mechanism into the lower channel cut-out in the enlarged section of the unitary body; whereby, then a muzzle/flash suppressor is inserted within the enlarged section, the lower section of the locking mechanism will clear the muzzle/flash suppressor (the side columns being in side channels, clear of the hollow within the enlarged section) and when the muzzle/flash suppressor is seated against the tapering down section of the unitary body, the locking mechanism is released and the arcual lower section will mate into a corresponding arcual channel about the muzzle end/flash suppressor—thereby holding the inventive adapter in place on the end of the rifle's muzzle.

As described, the subject inventive muzzle grenade adapter has a forward narrower generally cylindrical diameter section, an enlarged rear generally cylindrical section, and a tapered section between the narrower and enlarged sections (tapering up from the narrower to the enlarged section; which taper may be at an angle of up to 90 degrees with respect to the surface of the narrower section). The length of the forward, narrower section of the adapter is such that the muzzle mounted grenade when fully mounted about its perimeter will not cover the entry length of the adapter's forward narrower section. The length of the enlarged rear section is such that it will accommodate therein the length of the flash suppressor. The arcual lower section of the locking mechanism forms a tongue that fits into a corresponding arcual groove section about the rear of the flash suppressor—when the front of the flash suppressor impacts against the tapered section.

The other objects, features and advantages of the present invention will become more apparent in light of the figures contained herein and the following detailed description thereof.

DETAILED DESCRIPTION OF A PREFERRED EMBODIMENT OF THE INVENTION

Figure 1:
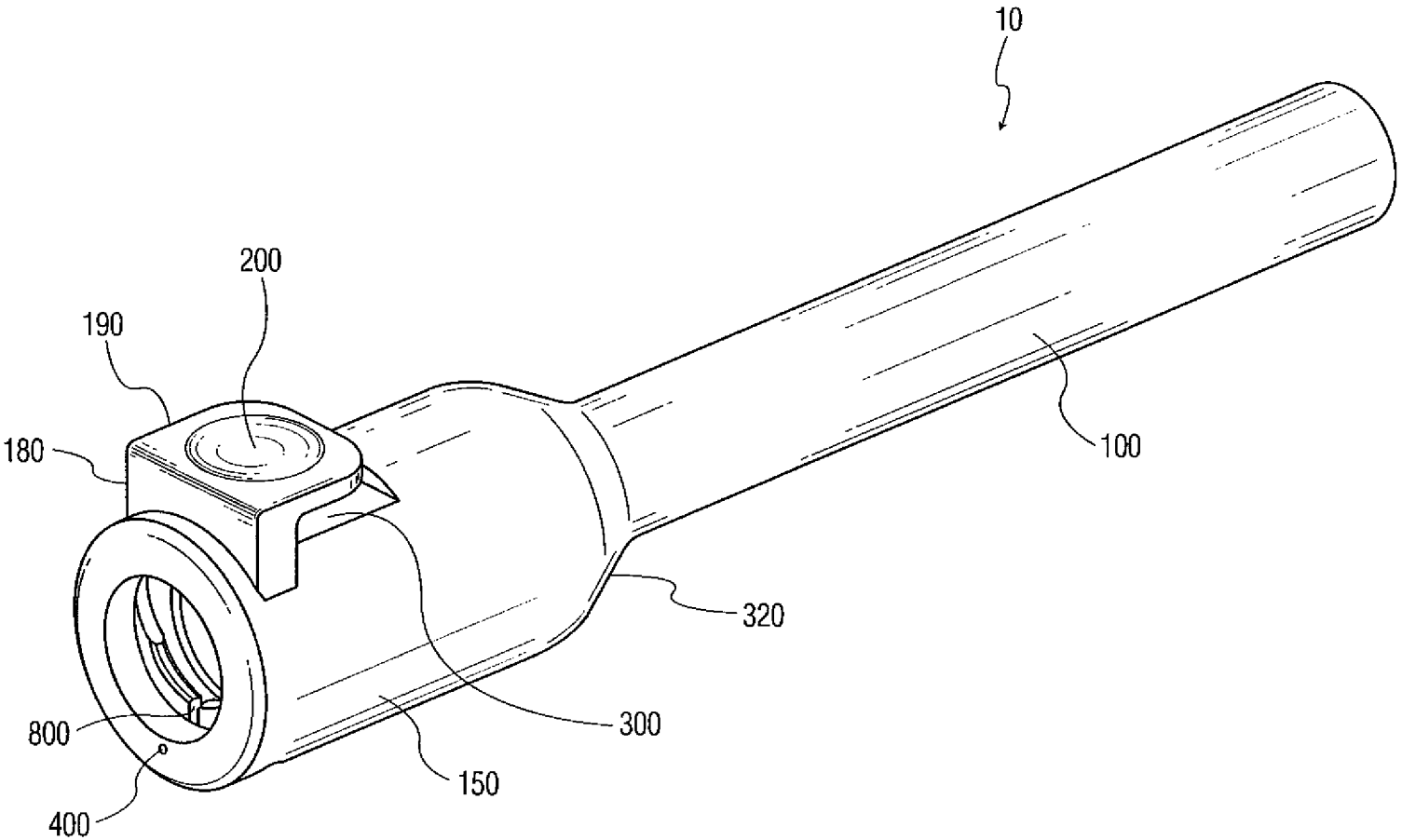
FIG. 1. is an isometric view of an adapter of the present invention.
Figure 2:
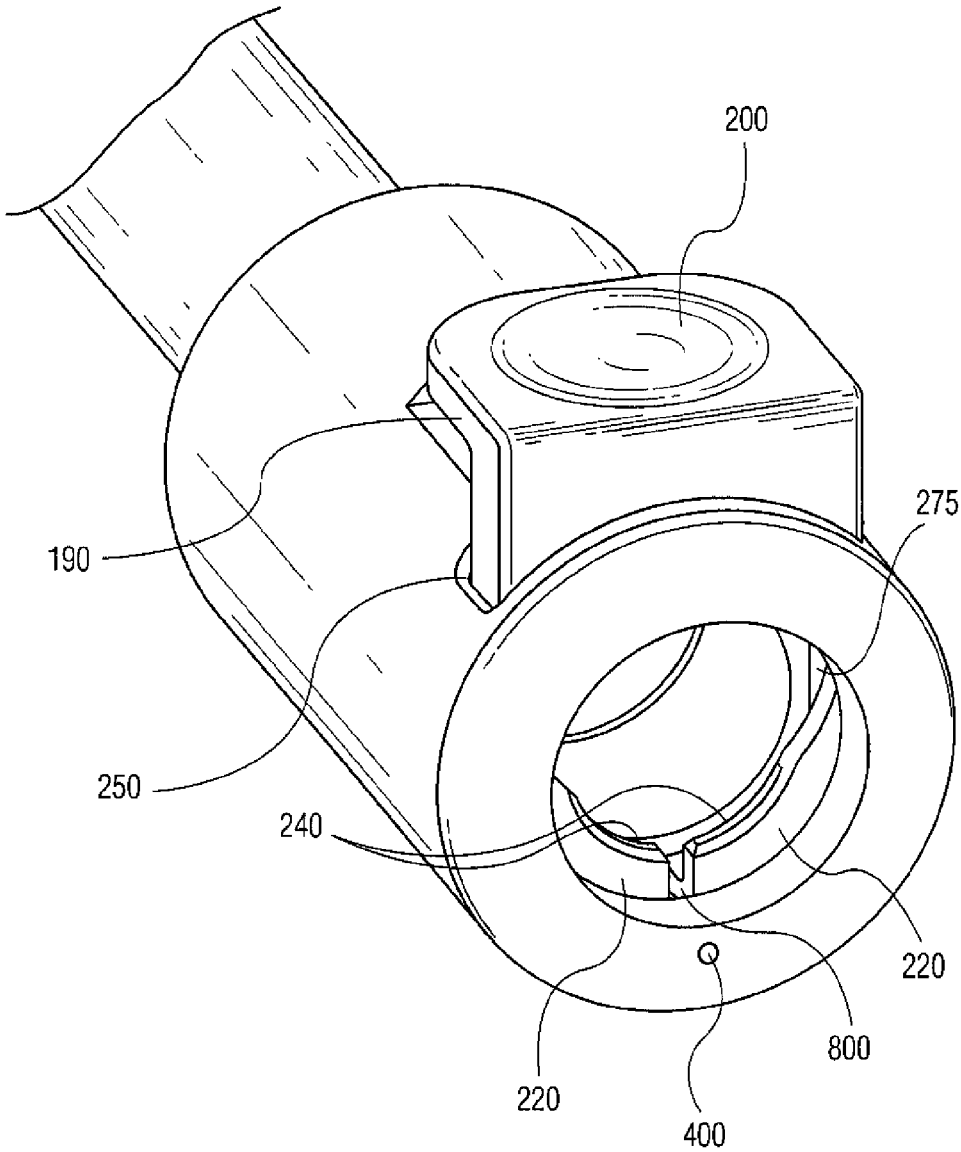
FIG. 2. is an enlarged view of the enlarged rear section of an adapter of the present invention, which portion fits over and accommodates the end of a military rifle barrel having a flash suppressor mounted thereon.
Figure 3:
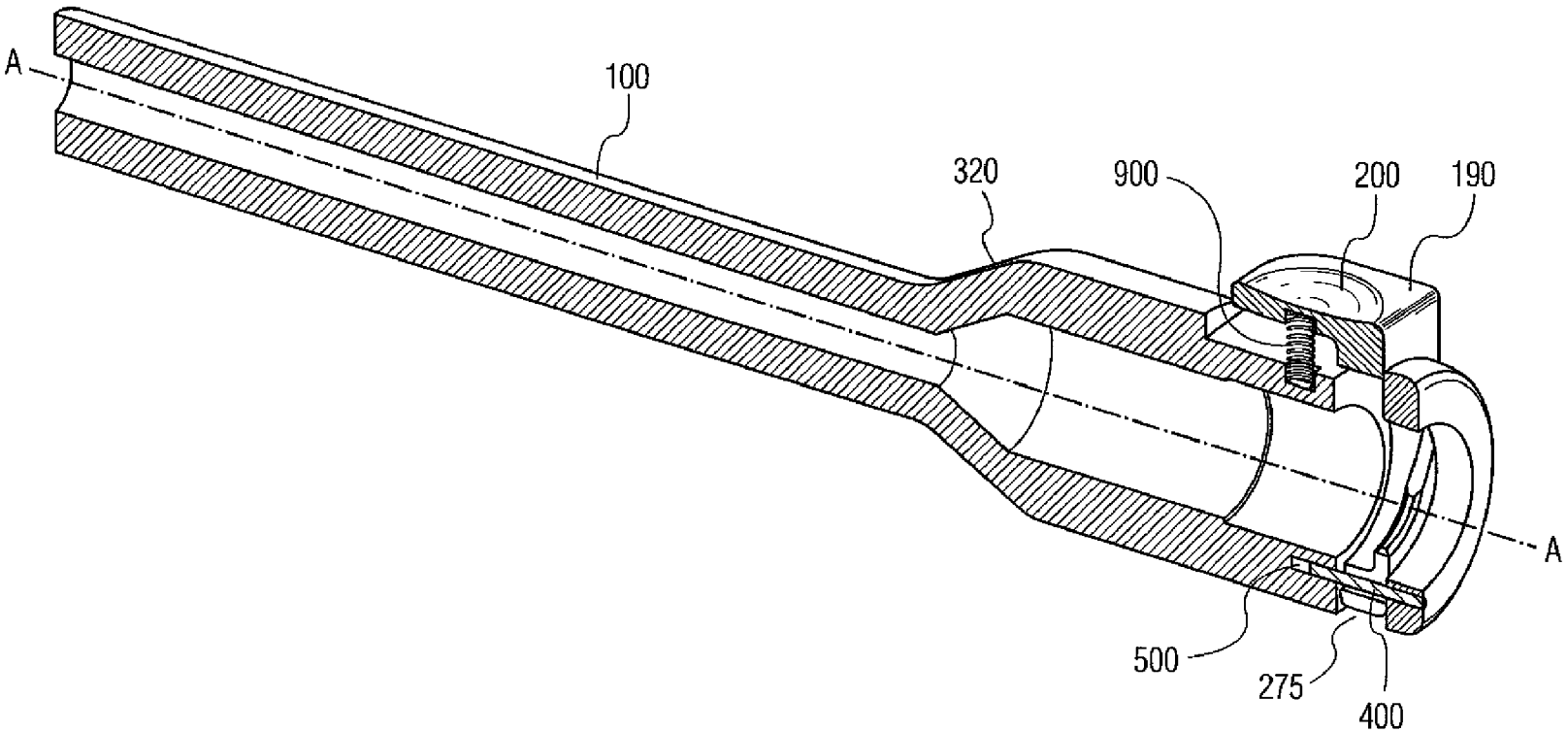
FIG. 3. is a cut-away side view of an adapter of the present invention.

As shown in FIGS. 1, 2, and 3, the subject inventive muzzle grenade adapter 10 is formed of four parts, an elongated generally cylindrical unitary body having a central channel longitudinally therethrough, which channel is aligned along a centerline, A-A, shown in FIG. 3. The unitary body has a narrow diameter hollow front section 100, a hollow tapered section 320 extending from the narrow front section 100 to an enlarged diameter hollow rear section 150 (with a taper that may be at an angle of up to 90 degrees with respect to the outer surface of the cylindrical narrow front section 100); which enlarged rear section 150, fits over and accommodates therein the muzzle end of a rifle barrel fitted with a flash suppressor (not shown). As stated, all three sections are hollow and aligned to allow a the bullet to pass therethrough, along a center line A-A which extends from the enlarged diameter rear section 150 into and through the tapered section 320, and narrowed front diameter section 100. Which bullet, after passing through the three sections of the adapter 10, enters into a muzzle mounted grenade (not shown), i.e. mounted about the front exterior portion of the narrowed front section 100.

Referring to FIGS. 2 and 3, a unitary locking mechanism 180 can be seen, which mechanism is provided to secure the adapter in place on the end of the rifle muzzle, and a pin 400, fitted through a slot 800, secures the unitary locking mechanism 180 within adapter 10. The unitary locking mechanism 180 is housed within the enlarged rear section 150 of the adapter 10, wherein it is positioned within an upper channel cut-out 250 and within a corresponding lower channel cut-out 275.

The portion of the unitary locking mechanism 180 that is positioned within the upper channel cut-out 250 has a raised section 190, extending away from and then parallel to and above a corresponding indentation 300 within the surface of the enlarged rear section 150, the raised section having a top surface which provides a finger push 200. The portion of the unitary locking mechanism 180 that is positioned within the upper and lower channel cut-outs 275 of the enlarged rear section is in the form of a two side columns that connect to a thin arcual sections 220 having a concave arcual face 240, which arcual face 240 opens into the inner hollow of the enlarged rear section 150. The raised section 190 is biased in its raised position by a bias spring 900, the bias spring being located between the outer surface of the enlarged rear section 150 and the bottom side of the raised section 190. Normally the bias spring 900 will keep the raised section 190 of the finger push above and away from the corresponding depressed surface 300 within the enlarged rear section 150. As stated, the depressed surface 300 corresponds to the raised section 190, and is of a configuration to accept the raised section 190 when it is depressed. Therefore, when pressure is applied to the finger push 200, the bias spring 900 will be compressed, the raised section 190 will move into the upper channel cut-out 250, and the two side columns and connected thin arcual sections 220 will move deeper into and through the lower channel cut-out 275 and partially extend out past the lower portion of the outer surface of the enlarged section 150; whereby, then a rifle muzzle, with or without a flash suppressor, is inserted within the enlarged section 150, the rifle muzzle will be able to enter the enlarged rear section 150 without interference by either the side columns or the thin arcual sections 220 of the unitary locking mechanism 180. When the end of the rifle muzzle, with or without a flash suppressor, is abutted against the tapered section 320 of the unitary body and the pressure against the finger push 200 is released, the bias spring 900 will expand and extend to its normal position, and the top arcual surface 240 of the thin arcual section 220 will mate into a corresponding arcual channel about the rifle muzzle or its flash suppressor (not shown) thereby holding the inventive adapter 10 in place about the muzzle of the rifle.

As shown in the various figures, especially FIG. 3, a pin 400 is used to hold the locking mechanism 180 in place within the upper channel 250 and in the corresponding lower channel 275 cut-outs. The pin is lodged in a channel 500 that extends across the lower channel 275 cut-out and through a u-shaped cut out 800 (FIG. 1) in the thin arcual section 220. The pin may be held in place within the channel 500 by a force fit or it may be screwed in place, by simply providing a threaded channel 500 and a corresponding screw threat about the exterior of the pin 400.

The unitary body of the subject inventive adapter 10 can preferably be machined from a bar of aluminum, a relatively strong and light weight material, or of any similar metal or alloy. If the adapter is manufactured of aluminum, it is preferably anodized to increase corrosion resistance, to increase surface hardness, and to allow coloring of the adapter's body.

The bias spring, 900 can be manufactured of stainless steel, such as 302 stainless steel, a steel similar to 18/8 steel. A particular, preferred, bias spring may have a total of 20 coils, 14 of which are active and 8 bound equally within the bottom of the raised section 190 of the unitary locking mechanism 180 and the top of the corresponding depressed surface 300 of the enlarged rear section 150. Finally, the unitary locking mechanism 180 can be machined of stainless steel, such as 17-4 stainless steel, which is also known as type 630 steel, which is a hardened stainless alloy containing 17% chromium, and 4% nickel.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. An adapter for mounting muzzle fired bullet trap type grenades on short barreled rifles comprising:

said adapter having an elongated unitary body divided length-wise into a narrow cylindrical front section, a tapered midsection, which midsection tapers out from the narrow front section to a greater diameter cylindrical rear section, with an aligned central longitudinal channel extending through all three sections, which channel has a common center line;

the section of the central longitudinal channel within the narrow front cylindrical section having a length that is greater than the length of the tapered midsection and a diameter sufficient to allow a bullet fired from said rifle to pass therethrough along said common center line without impacting the channel;

the section of the central longitudinal channel within the greater diameter cylindrical rear section being of a diameter to accept and extend over the muzzle of said rifle;

the section of the central longitudinal channel within the midsection tapering down from the diameter of the section thereof within the greater diameter rear section, to the diameter of the section within the narrow cylindrical front section;

the narrow cylindrical front section having sufficient length and an outside diameter to mount a muzzle fired bullet trap grenade thereabout, such that there is adequate overlap support for the mounted grenade to be accurately aligned and fired on target;

said greater diameter cylindrical rear section having an upper channel cut-out, a corresponding lower channel cut-out, and two side channels therebetween within the opposed walls of the greater diameter cylindrical rear sections, which cut-outs and channels are in a plan generally perpendicular to said common centerline, and which plan is adjacent the end said greater diameter cylindrical rear section;

a unitary locking mechanism having two side columns that extend through said upper channel cut-out, which side columns extending through the two side channels, and which side columns connect to the sides of an arcual shaped tongue located in and across the corresponding lower channel cut-out;

the unitary locking mechanism having a finger push section which extends from said side columns away from said greater diameter cylindrical rear section and bends over and parallel to the surface of the enlarged diameter cylindrical rear section in the direction of the narrow cylindrical front section;

the finger push section of the unitary locking mechanism being normally biased away from the surface of the enlarged diameter cylindrical rear section by a spring located between the finger push section and the surface of the enlarged diameter cylindrical rear section;

whereby, when the finger push section is pressed into a corresponding cut-out in the surface of the enlarged cylindrical rear section, the two side columns will push the arcual shaped tongue within the lower channel cut-out through and out of that cut-out, thereby allowing the muzzle of the rifle to be lodged within the enlarged rear section without being obstructed by the arcual shaped tongue which is normally located within the lower channel cut-out; and where, when the pressure is removed from the finger push section, the arcual shaped tongue will return to its normal position, the arcual tongue portion thereby mating into a corresponding channel near the end of the rifle muzzle and becoming held therein by the pressure of the spring; and where a locking pin is fixed by threads within the end of the enlarged diameter rear body section, central to the lower channel cut-out, which locking pin is positioned through a channel within the unitary locking mechanism, and through the lower channel cut-out, so as to ensure that the locking mechanism remains fixed within the enlarged rear cylindrical section, held in place therebetween by said pin and said spring.

2. The adapter for mounting muzzle fired bullet trap type grenades of claim 1, wherein, the bias spring has a total of 20 coils.

3. The adapter for mounting muzzle fired bullet trap type grenades of claim 1 wherein, the bias spring is manufactured of stainless steel.

4. The adapter for mounting muzzle fired grenades of claim 1, wherein, said unitary body is machined from a bar of aluminum.

5. The adapter for mounting muzzle fired bullet trap type grenades of claim 1, wherein, the unitary locking mechanism is machined of stainless steel.

6. The adapter for mounting muzzle fired bullet trap type grenades of claim 1, wherein the length of the section of the central longitudinal channel within the greater diameter cylindrical rear section is such that when the muzzle is positioned therein, the front of the muzzle will be stopped by the section of the central longitudinal channel within the midsection tapering down from the diameter of the section thereof within the greater diameter rear section, to the diameter of the section within the narrow cylindrical front section, such that the arcual tongue portion will mating into the corresponding channel near the end of the rifle muzzle.

7. The adapter for mounting muzzle fired bullet trap type grenades of claim 6, wherein the muzzle has a flash suppressor thereon.

* * * * *